US010102828B2

(12) United States Patent
Priel et al.

(10) Patent No.: US 10,102,828 B2
(45) Date of Patent: Oct. 16, 2018

(54) METHOD AND APPARATUS FOR ADAPTIVE GRAPHICS COMPRESSION AND DISPLAY BUFFER SWITCHING

(71) Applicants: Michael Priel, Netanya (IL); Ran Ferderber, Mazor (IL); Michael Zarubinsky, Rishon Lezion (IL)

(72) Inventors: Michael Priel, Netanya (IL); Ran Ferderber, Mazor (IL); Michael Zarubinsky, Rishon Lezion (IL)

(73) Assignee: NXP USA, Inc., Austin, TX (US)

( * ) Notice: Subject to any disclaimer, the term of this patent is extended or adjusted under 35 U.S.C. 154(b) by 0 days.

(21) Appl. No.: 14/655,183

(22) PCT Filed: Jan. 9, 2013

(86) PCT No.: PCT/IB2013/050181

§ 371 (c)(1),
(2) Date: Jun. 24, 2015

(87) PCT Pub. No.: WO2014/108741

PCT Pub. Date: Jul. 17, 2014

(65) Prior Publication Data

US 2015/0348514 A1 Dec. 3, 2015

(51) Int. Cl.

| | |
|---|---|
| ***G09G 5/00*** | (2006.01) |
| ***G09G 5/377*** | (2006.01) |
| ***G09G 5/36*** | (2006.01) |
| ***G09G 5/397*** | (2006.01) |

(52) U.S. Cl.

CPC ..... *G09G 5/377* (2013.01); *G09G 5/36* (2013.01); *G09G 5/397* (2013.01); *G09G 2330/021* (2013.01); *G09G 2340/02* (2013.01); *G09G 2340/125* (2013.01); *G09G 2360/18* (2013.01)

(58) Field of Classification Search

CPC ..... G09G 2340/02; G09G 5/377; G09G 5/36; G09G 2330/021; G09G 5/397; G09G 2340/125; G09G 2360/18

USPC ..... 345/530, 531, 533, 537, 538, 540, 543, 345/544, 545, 546, 547, 555

See application file for complete search history.

(56) References Cited

U.S. PATENT DOCUMENTS

| | | | | |
|---|---|---|---|---|
| 5,712,664 | A | 1/1998 | Reddy | |
| 8,026,944 | B1 * | 9/2011 | Sah | H04N 7/181 348/143 |
| 8,116,579 | B2 | 2/2012 | Fenney et al. | |

(Continued)

OTHER PUBLICATIONS

International Search Report and Written Opinion correlating to PCT/IB2013/050181 dated Sep. 27, 2013.

*Primary Examiner* — Sarah Lhymn

(57) ABSTRACT

There is provided a multimedia computing apparatus for processing and displaying video data with overlay graphic data, said multimedia computing apparatus comprising a compression unit arranged to compress graphic overlay data prior to storage of said compressed overlay graphic data in a compressed display buffer, and a control unit arranged to determine when to compress the overlay graphic data dependent upon a refresh parameter of the overlay graphic data. There is also provided a method of adaptively compressing graphics data in a multimedia computing system comprising dynamically controlling compression of graphic overlay data in a display buffer dependent upon a refresh parameter of the graphic overlay data.

16 Claims, 9 Drawing Sheets

(56) References Cited

U.S. PATENT DOCUMENTS

| | | | | |
|---|---|---|---|---|
| 2002/0059547 | A1* | 5/2002 | Nozuyama | G01R 31/31859 714/738 |
| 2003/0160893 | A1* | 8/2003 | Greenfield | H04N 21/23406 348/419.1 |
| 2006/0053233 | A1 | 3/2006 | Lin et al. | |
| 2006/0092320 | A1* | 5/2006 | Nickerson | G09G 5/391 348/441 |
| 2008/0288992 | A1* | 11/2008 | Usman | G06F 3/1454 725/105 |
| 2009/0268090 | A1 | 10/2009 | Chung et al. | |
| 2011/0161667 | A1* | 6/2011 | Poornachandran | G06F 21/84 713/168 |
| 2011/0169845 | A1* | 7/2011 | Sreenivas | G09G 5/363 345/536 |
| 2011/0211726 | A1 | 9/2011 | Moed et al. | |
| 2011/0249757 | A1 | 10/2011 | Newton et al. | |
| 2013/0262538 | A1* | 10/2013 | Wegener | G06F 13/28 708/203 |
| 2013/0268741 | A1* | 10/2013 | Daly | G06F 12/023 711/165 |
| 2013/0307835 | A1* | 11/2013 | Wu | G09G 3/3611 345/212 |
| 2014/0086309 | A1 | 3/2014 | Beer-Gingold et al. | |

* cited by examiner

COMPRESSING EXT. MEM
BUFFER
DATA PATHS

COMPRESSING ON-DIE MEMORY BUFFER DATA PATHS

METHOD AND APPARATUS FOR ADAPTIVE GRAPHICS COMPRESSION AND DISPLAY BUFFER SWITCHING

FIELD OF THE INVENTION

This invention relates to multimedia computing systems in general, and in particular to a method and apparatus for adaptive graphics compression and display buffer selection and switching in multimedia computing systems.

BACKGROUND OF THE INVENTION

Multimedia computing devices are able to decode and present multimedia content data, such as video or audio. They are also able to generate and present locally generated graphics data. Often the graphics data is presented as a form of overlay on the multimedia data.

For example, a popular use case for many multimedia computing devices, especially portable multimedia computing devices, is to download (or create), store, and subsequently or concurrently process and display multimedia data, such as video, moving graphics or the like, together with audio. This may involve providing some form of computer generated graphics overlaying the presented multimedia content data. For example, a user interactive menu system (such as an Electronic Programming guide (EPG) system control menu, or the like), or simply some playback controls above/below the video to allow a user to control the playback of the video (i.e. providing, e.g. touchscreen based play, stop, fast forward, rewind buttons, etc). The overlay may also show pertinent information on the video itself, such as playing time left/elapsed, total video length and the like.

When any computing device drives a display, this is usually done by filling a display buffer with data representing each pixel of each frame to be displayed. A display buffer may store one or more frames ready for display. The display buffer can act as a temporary store of display data that has already been processed by the computing system ready for display, and as such, may allow the computing system to carry out other tasks, for example decode/render later frames, or enter a lower power state during the periods when the data from the display buffer is being used for display.

When overlay graphics data is used with decoded multimedia data, the respective content data (multimedia or graphics) is decoded and stored in uncompressed format (i.e. in the form of a data representation, such as binary number, for each pixel in the display) within a display buffer. A display buffer may also be called a frame buffer, since the uncompressed data may be stored frame by frame. The display buffer comprises an area of memory, with sufficient space to store a digital data representation for each and every pixel in the display being driven from the respective display buffer.

The process of displaying the rendered graphics data and decoded multimedia data typically happens "on-the-fly", i.e. the respective data is read out of the display buffer (or respective display buffers, where more than one is used), and then combined in such a way as to actually display the intended display data for each pixel. For example, overlaying the graphics data on top of the video where appropriate (e.g. where a control is to overlay the video), or not overlaying the graphics data, and leaving just the decoded video data to be displayed (e.g. in a 'clear' area of video, not intended to have any overlaid graphics).

SUMMARY OF THE INVENTION

The present invention provides a multimedia computing apparatus for processing and displaying video data with overlay graphic data as described in the accompanying claims.

Specific embodiments of the invention are set forth in the dependent claims.

The present invention also provides a method of adaptively compressing graphics data in a multimedia computing system.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the figures are illustrated for simplicity and clarity and have not necessarily been drawn to scale.

DETAILED DESCRIPTION OF THE PREFERRED EMBODIMENTS

Figure 1:
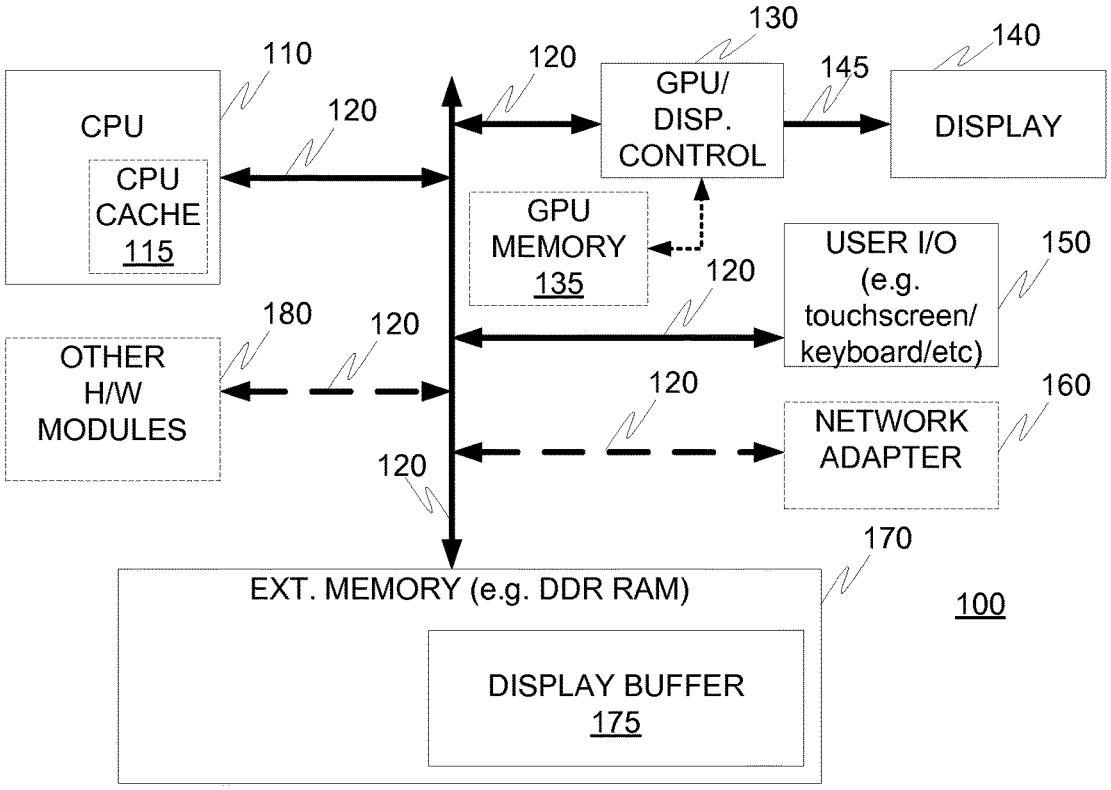
FIG. 1 shows a schematic diagram of a first discrete processor based example multimedia computing system to which the invention may apply.

Because the illustrated embodiments of the present invention may for the most part be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Examples of the present invention provide a method and apparatus for adaptively compressing display data, for example graphics overlay data, in a computing system (for example, a multimedia computing system). This may be done so that the computing system does not cause as great a load on the memory data bus, over which the graphics data is usually sent or received, during use (e.g. to/from the display buffer). Usually, this data bus is the external memory data bus, but other data buses, connected to other forms of memory within the computing system are equally envisaged. By reducing the load on (i.e. usage of) the data bus over which the graphics data is sent and received during processing for display, the system reduces power consumption, and may also help reduce any potential or actual data bus/memory deficits.

Examples of the invention may also provide selection between using an on-die display buffer and the external memory based display buffer, so that, in extremis, the external memory buffer may be placed into a reduced power mode, powered down completely, or completely reassigned for use with another process within the computing system.

The methods and apparatus may also be viewed as methods and apparatus to reduce power usage in a computing system, and may be particularly used in implementations having a large degree of semiconductor integration, for example, System on Chip implementations of multimedia and/or applications processors.

The following examples of the invention will be cast in the context of graphics overlay data compression, and selection of suitable display buffers for storing compressed graphics overlay data. The specific example will be the playback of video with overlaid controls, but other general and specific use cases are also envisaged as being compatible with and derive benefit from implementation of the invention.

In the described examples, a typical display processing flow for multimedia computing systems may include rendering the graphics overlay using a Computer Processing Unit (CPU) (potentially operating in a dedicated graphics mode) or a dedicated Graphics Processing Unit (GPU) of the multimedia computing system. The rendered graphics may be stored in uncompressed form initially, ready for use by a suitable overlay unit, to thereby overlay the rendered graphics overlay data on top of decompressed video, or other (relatively constantly) changing display data. Therefore, substantially concurrently, the multimedia computing system may be processing other data, for example video data, such that it is decoded into uncompressed video, and stored as decoded video (e.g. decoded video frames that are ready for display) in a same or different display buffer as the graphics overlay data. Typically, the uncompressed display buffer(s) may be located in the external memory, for example, Double Data Rate-Dynamic Random Access Memory (DDR-DRAM).

Standard video playback display refresh rates may be anywhere between 10 and 200 frames per second (e.g. low frame rates of 10 fps may be used in video captured locally to a low power mobile device, whilst the very high 200 fps may be used in some higher end TV's, to reduce motion blur and the like), with a more typical video frame rate being between 24 fps and 60 fps (covering the most typical global TV frame rate standards, or multiples thereof). Meanwhile, the graphics overlay content may be usually user-interface data, which only changes relatively slowly (e.g. no more than 5 times per second, but usually much less often). For example, the graphics overlay data may be typically user interaction defined—i.e. it changes when the user interacts with the multimedia computing system. However, it may also include system interaction timing, i.e. where it is the system interacting with the graphics overlay data in some way. For example, when a clock display may be updated to show the next time unit, such as a change in the minute or the like. Either way, these are relatively slow changes to the graphics overlay data.

By compressing the graphics overlay data whilst is it stable (i.e. non-changing), it is possible to reduce the overheads on the graphics memory sub-system, and as a result, reduce power consumption and the like. The definition of stable data may be use case dependent, and may be, for example, defined in relation to time since last interaction (user or system), or may be defined (in part or whole) based on known or expected future state changes—such as clock timing and the like. The definition of stable data may also be defined through statistical use analysis, either based on (actual) historic use of the same or similar computing system, in a same or similar use-case or on likely future use based on assumption(s) made on the use-case involved. This latter predictive use may be modelled at the time of developing the computing system, or at the time of developing the (new) use-case, or may be carried out as an initial learning phase of newly instigate hardware, or the like. Equally, fixed parameters may be used instead—such as, but not limited to, fixed time lengths, and the like.

Due to the way in which "on-the-fly" overlaying works, previously, even if the graphics overlay data did not change, the same graphics frame would be read several times from the display buffer in the external memory, e.g. DDR-DRAM. Typically, it would be read for each frame that was to be displayed. This resulted in extra load on the external memory (e.g. DDR) interface and therefore caused significant (maintenance of or increase in) power consumption.

Where the overall multimedia computing system is implemented in a highly integrated Integrated Circuit (IC), for example a System on Chip multimedia applications processor, the uncompressed display buffer may not be placed in an on-chip memory, because the amount storage needed for the display buffer is too large to be cost effective (it would require too much silicon real estate).

FIG. 1 shows a schematic diagram of a first discrete processor based example multimedia computing system 100 to which the invention may apply, for example a desktop PC, laptop or the like.

The discrete processor based example multimedia computing system 100 of FIG. 1 comprises a main CPU 110, that may or may not include a local CPU cache 115 (for example level 1 or 2 cache) for temporarily storing data for use by the CPU during its operation. The CPU 110 may be connected to the rest of the computing system by any suitable communications links. For example, by a common bus 120 (as shown), but may also be connected by a set of dedicated links between each entity (e.g. CPU, memory, network adapter, etc) within the computing system 100, or a combination of shared buses for some portions and dedicated links for others. The invention is not limited by the particular form of communications links in use in respective portions of the overall computing system. Thus, entities within the computing system are generally able to send and/or receive data to and/or from all other entities within the computing system.

In the example shown in FIG. 1, the discrete processor based example multimedia computing system 100 further comprises a GPU/display control unit 130, potentially operatively coupled to a GPU memory 135. The GPU/display control unit 130 may be a combined entity, including both the GPU and the necessary physical links (e.g. line drivers, etc) to the display 140 (e.g. Liquid Crystal Display—LCD, plasma display, Organic Light Emitting Diode—OLED, or the like), or may only include the necessary physical links (e.g. line drivers, etc) to the display 140, for example where there is no actual GPU, and instead the graphics are produced by the CPU 110 in a dedicated graphics rendering mode or similar. This is the say, the discrete processor based example multimedia computing system 100 may not include the 'discrete' graphics acceleration provided by having a GPU (where 'discrete' here may not mean separation of the GPU from the CPU in terms of semiconductor die, but does mean there is separate dedicated graphic rendering capability). Where a GPU is present, the system may further include a dedicated GPU memory 135, for use in processing graphics prior to display. Where such a GPU memory is not present, the GPU (or CPU in graphics mode) may use the external memory 170 instead.

The GPU and/or display adapter 130 may be operably connected to the display 140 via dedicated display interface, 145, to drive said display 140 to show the graphical/video output of the discrete processor based example multimedia computing system 100. Examples of suitable dedicated display interfaces include, but are not limited to HDMI (High Definition Multimedia Interface), DVI (Digital Video Interface) or analog interfaces.

The discrete processor based example multimedia computing system 100 may further include one or more user input/output (I/O) units 150, for example, to provide connection to, and therefore input from a touchscreen, mouse, keyboard, or any other suitable input device, as well as driving suitable output devices such as speakers, fixed function displays (e.g. 9 segment LCD displays, LED flashing signal lights, and the like). The user I/O unit 150 may, for example, further include or comprise a Universal Serial Bus (USB) controller, Firewire controller, Thunderbolt controller or the like. The discrete processor based example multimedia computing system 100 may also further include a network adapter 160, for coupling/connecting the discrete processor based example multimedia computing system 100 to one or more communications networks. For example, WiFi (e.g. IEEE 802.11b/g/n networks), wired LAN (e.g. IEEE 802.3), Bluetooth, 3G/4G mobile communications standards and the like. The multimedia computing system 100 may also include any other selection of other hardware modules 180 that may be of use, and hence incorporated into the overall multimedia computing system 100. The optional nature of these hardware modules/blocks 180 is indicated by their dotted outlines.

The multimedia computing system 100 will also include a main external memory subsystem 170, operatively coupled to each of the other above-described entities, for example, via the shared bus 120. In the context of the present invention, the external memory may also include a portion (either permanently dedicated, or not, but otherwise assigned on boot up) for storing display data ready for display, known as a display buffer 175.

The invention may not be limited by any particular form of external memory 170, display 140, User I/O unit 150, network adapter 160, or other dedicated hardware modules 180 present or in use in the future.

Figure 2:
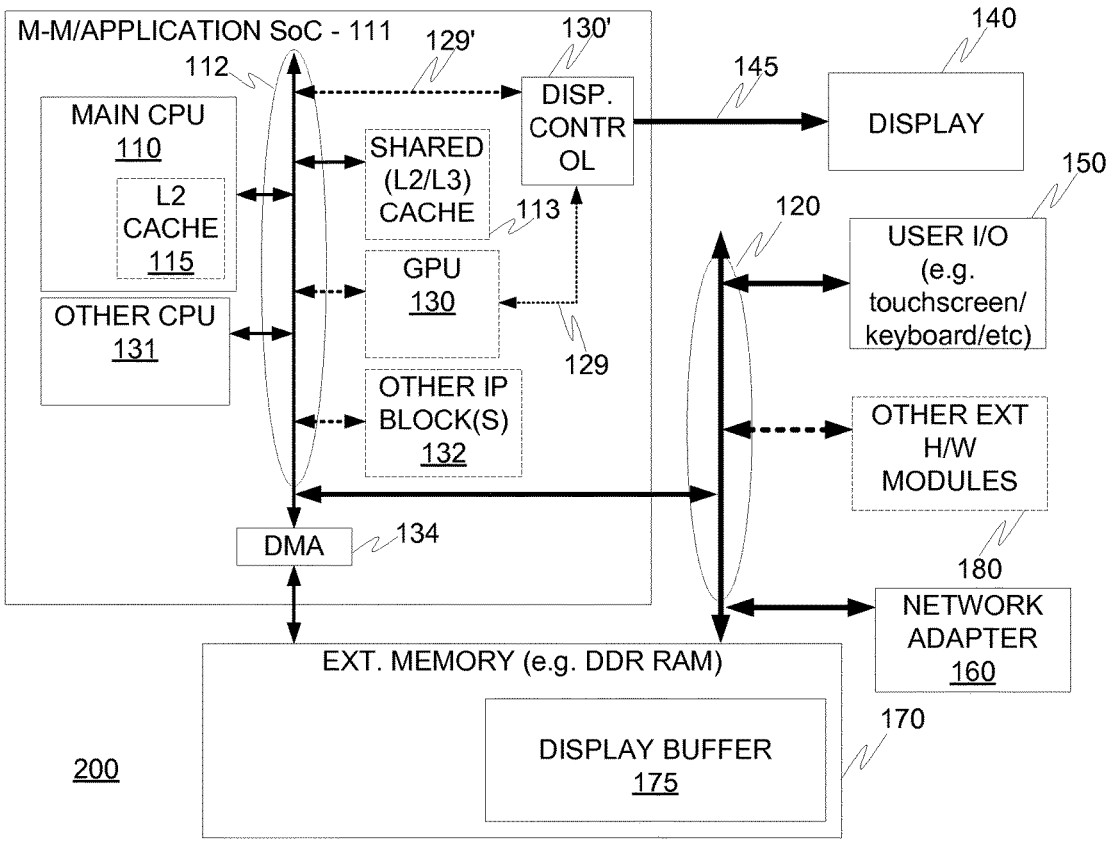
FIG. 2 shows a schematic diagram of a second System on Chip (SoC) integrated multimedia processor based example multimedia computing system to which the invention may apply.

FIG. 2 shows a similarly capable multimedia computing system to FIG. 1, except that the multimedia computing system is formed as a SoC multimedia computing system 200, i.e. formed predominantly as a highly integrated multimedia/applications SoC processor 111. In such a situation, more of/most of the overall multimedia system is formed within the same IC package (e.g. formed from two or more separate silicon dies, but suitably interconnected within the same package) and/or formed on the same singular integrated circuit semiconductor die itself. However, in this case, some portions of the overall computing system may still be formed from other discrete entities. This form of multimedia computing system is used more often in the portable, small form factor device use cases, for example, in the form of laptops, tablet computers, personal media players (PMPs), smartphones/feature phones, etc.

The majority of the SoC implemented multimedia computing system 200 is very similar to, or indeed the same as for FIG. 1, therefore they use the same references, and they act as described above (e.g. network adapter 160, etc).

However, there are some potential key differences. For example, the SoC 111 has its own internal bus 112 for operatively coupling each of the entities on the single/multiple semiconductor die(s) (again, a shared bus is used in this example, but instead they could equally be dedicated links, or more than a single shared bus, or any other logically relevant/suitable set of communications links) to allow the different entities/portions of the circuit (i.e. integrated entities—CPU 110, Other CPU 131, etc) of the SoC to communicate with each other. A SoC multimedia processor 111 may incorporate more than one CPU (or core) for use—thereby allowing multi-processor data processing, which is a common approach to provide more processing power within a given power (i.e. current/voltage draw/etc) envelope, and without having to keep on increasing CPU operating frequencies. Due to having multiple CPU's on the same die, there may be provided some form of shared cache—e.g. shared L2 or L3 cache 113. The SoC based multimedia computing system 200 may include other IP block(s) 132, dependent on the needs/intended uses of the overall system 200, and how the SoC designer provides for those needs/intended uses (e.g. whether he opts to provide dedicated processing resources for a selected operation, or whether he just relies on a general processor instead). In the example of FIG. 2, there is also included a Direct Memory Access (DMA) unit 134, to allow direct access to the external memory 170, and especially, in the context of this invention, the external memory display buffer 175.

In FIG. 2, there are two different example internal SoC graphic sub-system setups shown, but the invention is not so limited. These primarily differ in how the respective graphics entities (CPU 110, GPU 130, etc) communicate with each other.

For example, the first may involve the CPU 110 (when operating in some form of (dedicated) graphics mode) or GPU 130 communicating via the internal on-die shared bus 112, particularly including the display control dedicated communications portion, 129', coupling the display control unit 130' to the shared bus 112. The other method may be via a dedicated direct communications link, e.g. link 129 between, for example, the GPU 130 and display control unit 130' (a similar direct communications link is not shown between the CPU 110 and display control unit 130', but this form may equally be used where there is no GPU in the SoC). In the example shown, the display control unit 130' is integrated onto the same SoC multimedia processor 111, but may equally be formed of a discrete unit outside of the semiconductor die, and which is connected by some suitable dedicated or shared interface (not shown).

Regardless of how the CPU/GPU is connected to the display control unit 130', they may also be operatively coupled to the display buffer, for example located in the external memory subsystem 170. This so called external memory based display buffer 175 is accessible, in the example shown, via the internal shared bus 120, and the DMA unit 134 connected thereto. In this way, the display data is communicable to the display 140 via the display control unit 130' under control of the CPU 110 and/or GPU 130. The display buffers may also be included in the display adapter (not shown). Also, it will be appreciated that other suitable direct or indirect connections between the respective entities involved in rendering the display may be used, depending on the particular display driver circuitry configuration in use.

Figure 3:
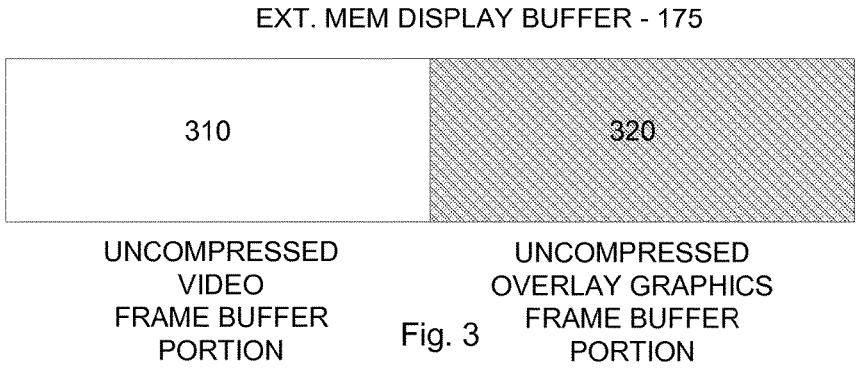
FIG. 3 shows an example fill status of an external memory display buffer of FIG. 1 or 2 during an example use in displaying video with overlay graphics.

FIG. 3 shows an example fill status of an external memory display buffer of FIG. 1 or 2 during an example use in displaying video with overlay graphics, in which a first portion 310 is full of uncompressed video (e.g. a video frame ready for display) whilst a second portion 320 is full of rendered uncompressed graphics data to be overlaid the video on the fly.

Figure 4:
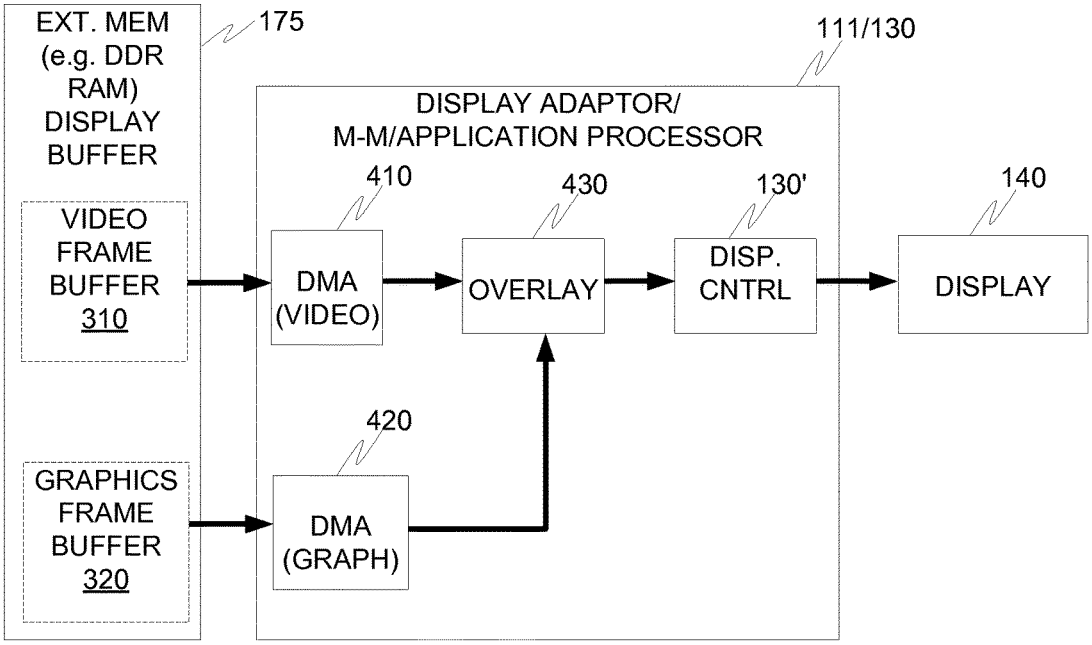
FIG. 4 shows a more detailed example schematic diagram of the portion of FIG. 1 or 2 that provides video with overlay graphics during an example use of the external memory display buffer of FIG. 3.

FIG. 4 shows a more detailed example schematic diagram of a portion of FIG. 1 or 2 that provides video with overlay graphics during an example use of the external memory display buffer 175 of FIG. 3. The external memory based display buffer 175 comprises a first buffer portion containing the video frame to be displayed (video frame buffer 310), and a second buffer portion containing the rendered uncompressed graphics overlay data (graphics frame buffer 320). The separate first and second portions may, in actual implementation, be a single memory area that is simply logically partitioned, interleaved, or the like.

As shown in the example of FIG. 4, the display adaptor 130 of FIG. 1, or the SoC multimedia processor 111 of FIG. 2 includes a video Direct Memory Access (DMA) module 410 operatively coupled to the (uncompressed) video frame buffer 310 within the display buffer 175 in the external memory 170, to directly load the (decoded) video data that is ready for display from the video frame buffer 310. Equally, a graphics DMA module 420 is operatively coupled to the (uncompressed) graphics frame buffer 320 portion of the external memory display buffer 175, to directly load the rendered and uncompressed graphics data that is ready for display from the graphics frame buffer 320. Both these DMA modules 410/420 forward their respectively loaded data to an overlay module 430 that combines the two display data sets on-the-fly to produce a single set of display data incorporating the video with the graphics overlay. The two separate DMA units 410 and 420 may be combined into a single dual use DMA unit, or the like (not shown), in some implementations.

Once the overlay unit 430 has produced the frame of video with the graphics overlay data overlaid thereon, ready for display, this may be passed to the display control unit 130' for eventual display out to the display unit 140.

In the example computing system of FIG. 4, it can be seen that the full uncompressed video data as well as full uncompressed graphics overlay data is being sent from the external memory display buffer 175 to the display unit 140, via the twin DMA units (410/420), overlay unit 430, and display control unit 130'. Due to the way in which "on-the-fly" overlaying works, the video data and graphics overlay data must be re-read for each successive display frame. Whilst the video data is changing every frame, the graphics overlay data may not be changing (e.g. because it is user input dependent, and that may not change for several seconds or more), so the graphics overlay data is likely the same for the next frame as it was for the previous frame. Thus, very high data rates are being used over the external memory interface (but essentially carrying the same, unchanging, data for a substantial amount of the time). Since this is uncompressed data, the data rate is potentially very high (which may lead to a deficit in available data rates as a whole within the computing system) and in any case, the power usage of the external memory interface is high.

Examples of the present invention seek to reduce the data rate burden on the display buffer, particularly when the display buffer 175 is located within the external memory 170. Examples do this by selectively compressing the graphics overlay data, for example when it is otherwise not changing over time, so that data being sent over the display buffer memory interface is (potentially much) reduced. Furthermore, the examples of the invention may further include a limited size on-die display buffer into which compressed graphics overlay data may be stored, and thus data over the external memory bus may be reduced to substantially zero (in terms of graphics overlay data, at least), in which case the external memory (or a substantial portion(s) thereof—at least those memory portion(s) which were to be used for the uncompressed graphics overlay data) may be placed into a lower power mode, or into very low/standby mode, and therefore save significant power. Moreover, the reduced burden on the external memory interface may mean the rest of the computing system has more unfettered access to the external memory—i.e. examples of the invention may reduce potential memory deficits (for example reducing the need for use of extended memory pages located in the main storage sub-system, such as hard drive system—i.e. remove the need for memory paging files).

Figure 5:
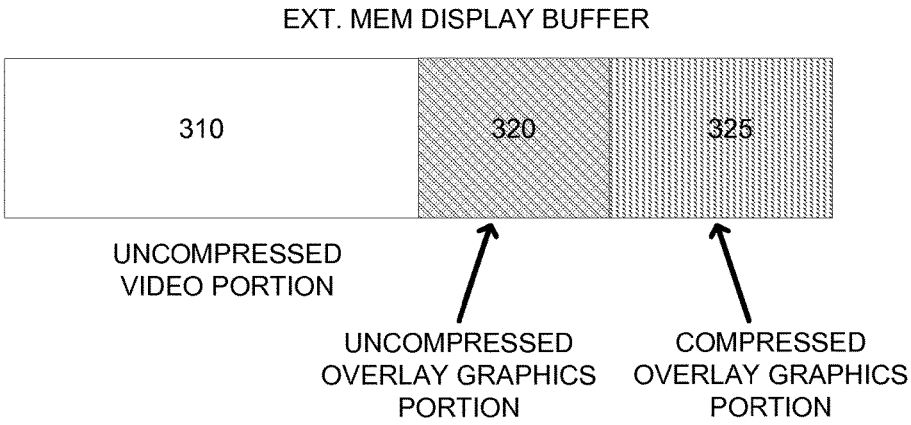
FIG. 5 shows an example fill status of an external memory display buffer with compressed and uncompressed overlay graphics data during an example use in displaying video with overlay graphics according to an example of the invention.

FIG. 5 shows an example fill status of an external memory display buffer 175 with uncompressed video data 310 ready for display, as well as compressed 325 and uncompressed 320 overlay graphics data portions. This might be the case, for example, when the computing system has (just recently) decided to start compressing the graphics data, so there is some graphics data that is still uncompressed, but there is some that is already compressed. This also might occur if the computing system has segregated a portion(s) of the display data that is relatively unchanging over time, and a portion(s) that are relatively variable over time. For example—a video file label portion may be unchanging over time, but the elapsed time portion is incrementing regularly. This is to say, different parts of the graphics overlay data can have different update/refresh rates, and so can have different compression regimes applied.

Figure 6:
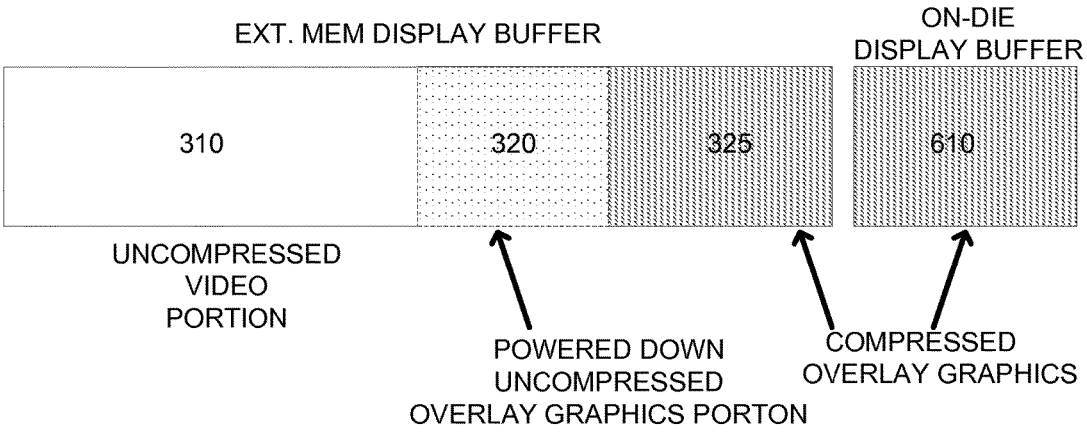
FIG. 6 shows an example fill status of an external memory display buffer with compressed and uncompressed overlay graphics data and an on-die display buffer with compressed overlay graphics data during an example use in displaying video with overlay graphics according to an example of the invention.

The uncompressed portion 325 of the display buffer shown in FIG. 5 may, in fact, not have any graphics data therein, since it has all been stored in the compressed portion 325. In this case, the uncompressed portion of the memory may be powered down to some degree (not shown, but is shown in FIG. 6). Alternatively this portion may be re-assigned for use by other parts of the overall computing system, to thereby reduce memory deficits.

The compressed graphic overlay data may be compressed by any suitable compression method and/or means, and may be decompressed accordingly, prior to display. The overlay graphics data may comprise any proportion of compressed graphics data compared to uncompressed graphics data, depending on various parameters of the graphics overlay data, such as its overall refresh rate, the refresh rates of different portions, or the like. In summary, it is generally (only) worthwhile compressing the graphics overlay data (or portion thereof) when it is sufficiently stable (i.e. non-changing). This is because, otherwise, the overhead of compressing (and decompressing) the data could be more than makes the compression worthwhile. How the computing system decides to use compression on the graphics overlay data may be dependent on a number of factors, and may be best determined using statistical analysis of typical usage patterns, or the like.

By compressing at least a portion of the graphics overlay data being stored in the external display buffer 175, the data rates to/from the external memory may be reduced, thereby allowing the memory to reduce its power draw. This then saves energy, which may be particularly useful in battery operated mobile computing devices (e.g. smartphones, tablets, PMPs, etc), or computing devices with otherwise limited power supplies (e.g. solar power or the like), or may equally act as a way to reduce the power consumption of standard mains powered computing systems, in a drive to reduce carbon emissions, running costs or the like.

FIG. 6 shows an example fill status of an external memory display buffer 175 with a portion of compressed graphics overlay data 325, a portion that is powered down 320, and an on-die display buffer 610 with compressed graphics data. This might occur in an example having an on-die display buffer (e.g. compressed graphics overlay display data), but where the on-die display buffer does not have enough room to store all the already rendered compressed graphics overlay data, and so there is "overspill" into the external memory buffer 175.

Thus, the potential energy savings (or, conversely, the ability to re-assign the external memory 170 to other uses, and hence reduce any external memory deficit) may be further improved by providing an on-die display buffer, i.e. a portion of storage means located on the same semiconductor die of the, for example, SoC multimedia applications processor 111. If the graphics overlay data may be compressed and stored in this on-die memory, then the respective (portions(s) of the) external memory, e.g. DDR RAM, may be powered down (completely, or to some degree) for the period, or totally reassigned for use by other portions of the computing system 100. A relatively modest/small on-die display buffer may be sufficient because compression is used on the graphics overlay data, and the actual storage means may be provided by some other shared storage means already on the semiconductor die, such as a shared cache or the like.

Figure 7:
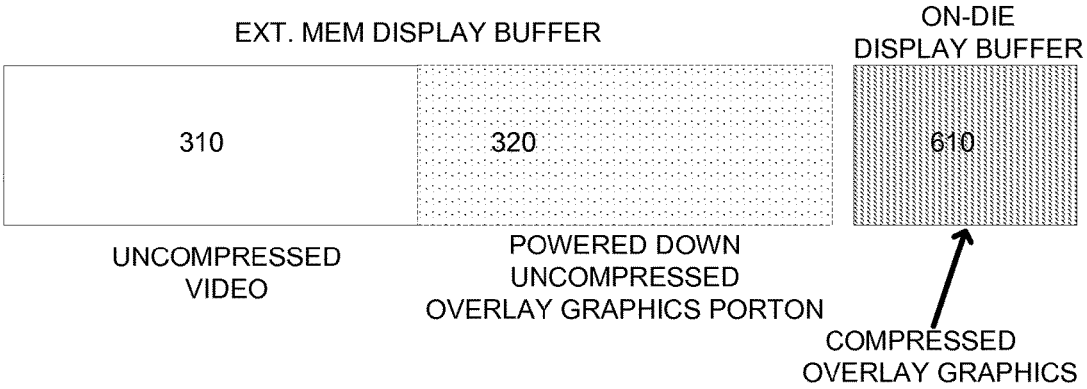
FIG. 7 shows an example fill status of an external memory display buffer with uncompressed video data and an on-die display buffer with compressed overlay graphics data during an example use in displaying video with overlay graphics according to an example of the invention.

FIG. 7 shows a particular use case of FIG. 6, where all the graphics overlay data is stored in the on-die display buffer, and therefore the (overlay) graphics portion of the external memory buffer 320 can be powered down (completely or to some degree), or reassigned to other uses within the overall computing system, for example as a temporary data store for video decoding, other (general) system processing, or the like.

Figure 8:
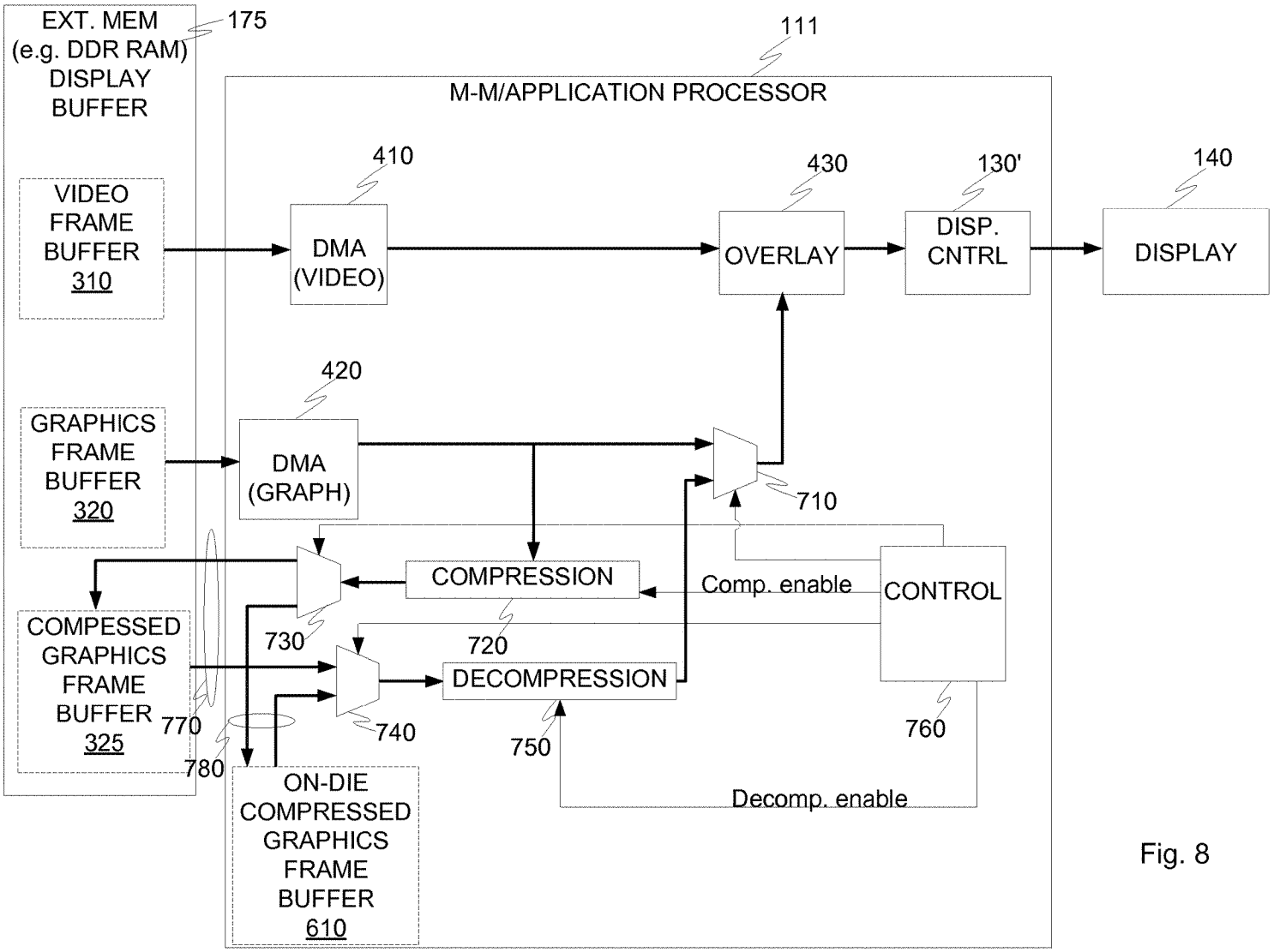
FIG. 8 shows an example schematic diagram of a compression control and external memory/on-die display buffer selection portion of a multimedia computing system according to an example of the invention.

FIG. 8 shows an example schematic diagram of a compression control and external/on-die display buffer memory selection portion of a multimedia computing system according to an example embodiment of the invention. Some portions are substantially similar to similarly numbered portions of FIG. 4 discussed above, and so may not be discussed in more detail below.

An external memory buffer 175 operatively coupled to a multimedia/application SoC processor 111 now provides a compressed graphics data portion, i.e. compressed graphics frame buffer 325, in addition to the already existing uncompressed video 310 and graphic 320 portions described above. There is also provided compression unit 720, to compress the graphics data prior to storage in the compressed graphics data portion 325 of the external memory buffer 175, or in an on-die compressed graphics frame buffer 610 discussed above, and a corresponding decompression unit 750. These two units are operatively coupled to the respective memory storage locations (compressed graphics data portion 325 of the external display buffer 175, and/or on-die compressed graphics frame buffer 610, respectively) via a set of multiplexers 710, 730, 740 that route the data between the respective memory storage locations under control of compression/decompression and compressed data storage selection control unit 760, as described in more detail with reference to FIGS. 9A and 9B. Thus, the multiplexers may provide a (compressed) external memory interface 770 and compressed on-die memory interface 780. The compression unit 720 and decompression unit 750 may be enabled/disabled, as suitable, via enable signals (shown) from the control unit 760, dependent on the given multiplexer settings in use at each moment in time. For example, the compression unit 720 may be disabled when the already compressed graphics overlay data is being read out of either compressed graphics buffers 325/610 through the decompression unit 750, to the overlay unit 430, or the decompression unit 750 might be disabled when the graphics data from the uncompressed graphic overlay portion is being compressed into either compressed graphics buffers 325/610. Equally, in some implementations, both compression 720 and decompression 750 units may be operational for substantially all the time, for example when parallel processing display data streams.

After combining the data from the two display data streams, i.e. the video and graphics data, into a single set of display data of the video including the overlaid graphics data, the overlay unit 430 passes said overlaid video data to a display control unit 440, as per prior methods which provides suitable drive signals to the display unit 140, for example an LCD or OLED display unit of an electronic device, such as tablet, smart phone, set top box or the like, in the usual way.

Figure 9A:
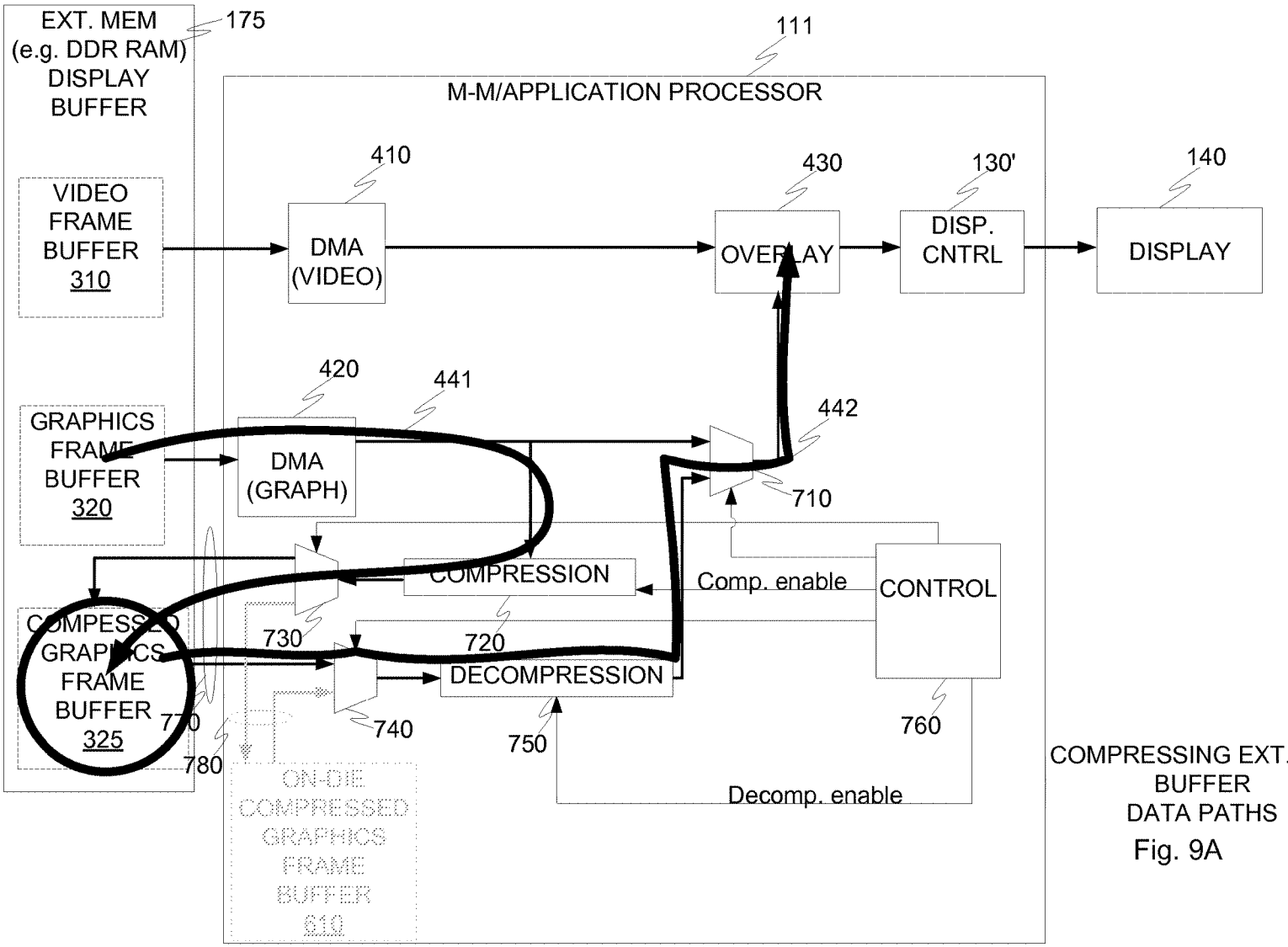
FIG. 9A shows the data flow in the schematic diagram of FIG. 8 when the external memory display buffer is used according to an example of the invention.

FIG. 9A shows the data flow in the schematic diagram of FIG. 8 when the external memory display buffer is used according to an example of the invention. In summary, there is a graphic data compression path portion, 441, in which the graphic overlay data is loaded in from the uncompressed portion 320 of the external memory based display buffer 175, by the DMA (graphics) unit 420, and sent out to a compressed portion 325 of the same external memory based display buffer 175, via the compression unit 720 (that applies any suitable compression technique, examples of the invention are not limited to using any specific type of compression) and the multiplexer 730 (and multiplexer 710, insofar as this multiplexer is arranged to not allow the uncompressed graphics data through to the overlay circuit 430).

Once compression is complete, the compressed video may be transferred to the overlay unit 430 for overlaying the uncompressed video (that may be transferred to the overlay unit 430 in the usual way, as shown and described above in relation to FIG. 4), by operation of a compressed graphics data load path portion 442. Both stages are shown as arrows over the respective parts of the circuit originally shown in FIG. 8, indicating the predominant (but not only) data flow in each case.

Figure 9B:
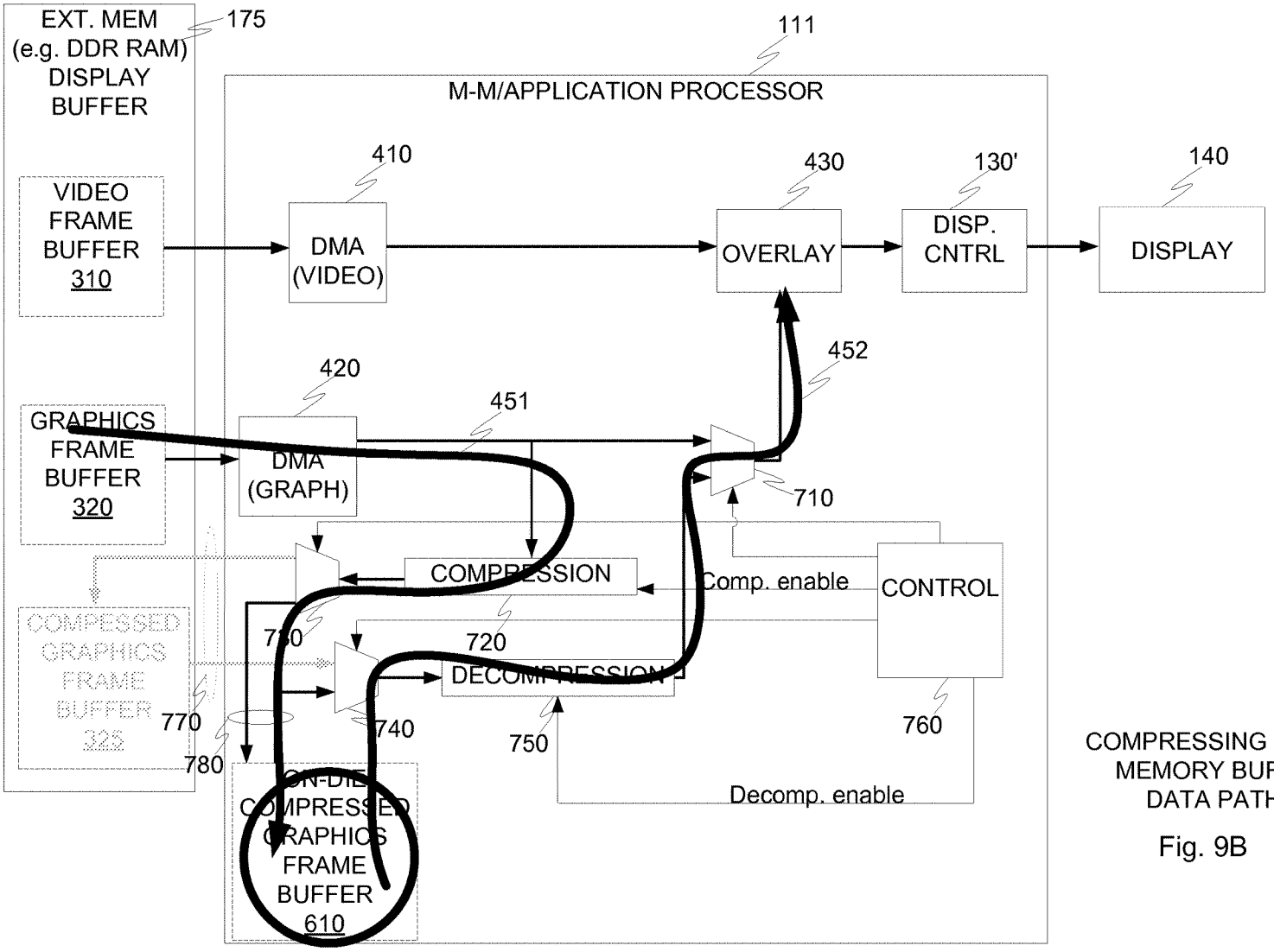
FIG. 9B shows the data flow in the schematic diagram of FIG. 8 when the on-die display buffer is used according to an example of the invention.

FIG. 9B shows the corresponding predominant data flow in the schematic diagram of FIG. 8 when the on-die display buffer is used instead of the compressed external display buffer 325, according to an example of the invention. In this example, there is also a graphic data compression path portion, 451, except this now takes the uncompressed graphics data from the uncompressed graphics frame buffer 320 in the external memory 170, and compresses it via the compression unit 720, but then stores the resultant compressed graphics data in the on-die (compressed) graphics frame buffer 610. Again, multiplexers 710 and 730 are suitably arranged to route the display data from the external memory 170 to the on-die buffer 610. Equally, once compressed, the compressed graphics overlay data may be provided to the overlay circuit 430 via the decompression unit 750, for example using multiplexers 740 and 710. In some embodiments, the apparatus may switch between the different graphics overlay data paths, as required by the status of the computing system at that point in time (and/or the (other) processes it is carrying out at that time).

Figure 10:
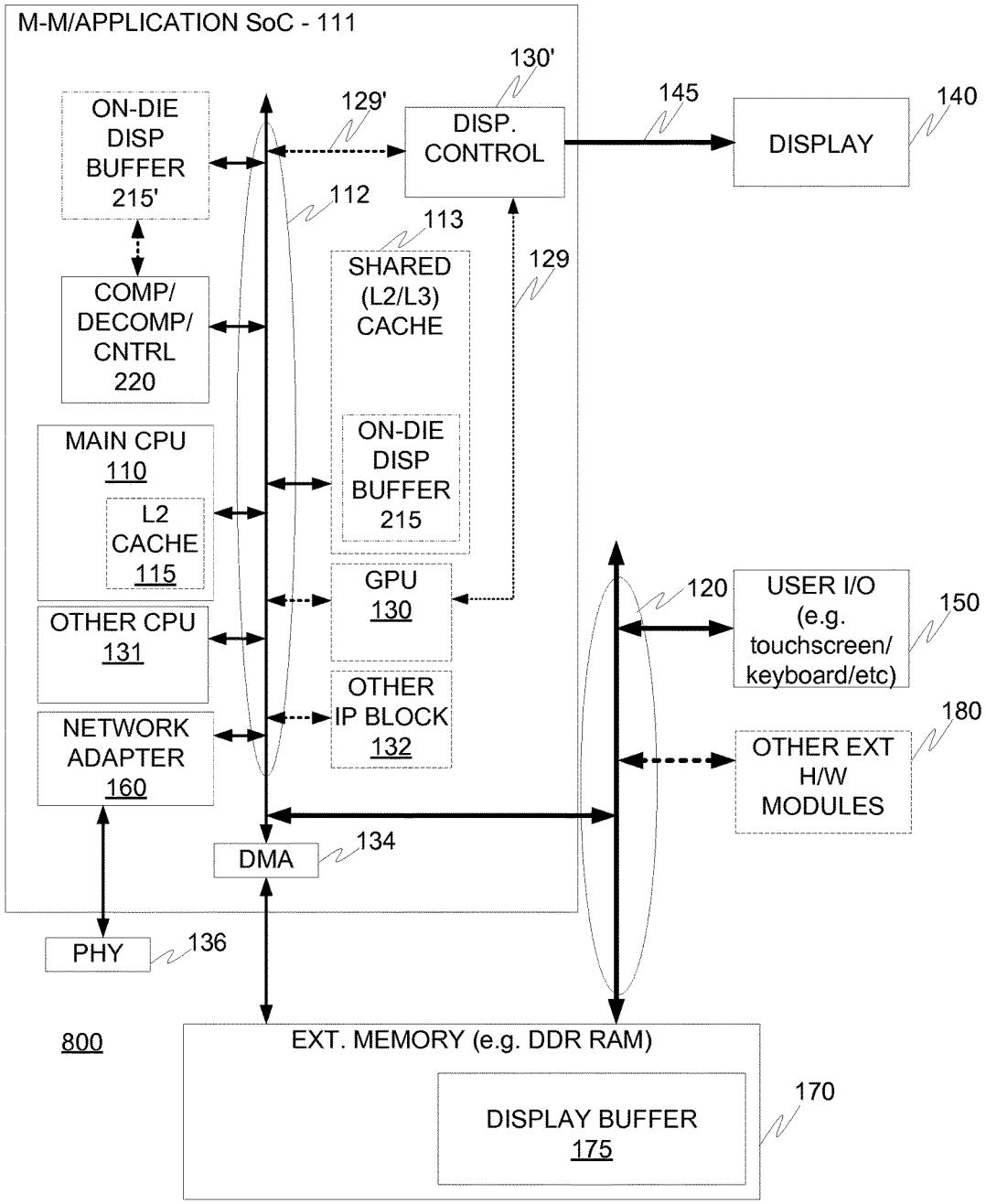
FIG. 10 shows an example schematic diagram of an overall SoC based multimedia computing system including compression control and external/on-die memory selection according to an example of the invention.

FIG. 10 shows an example schematic diagram of an overall SoC based multimedia computing system including compression control and external/on-die memory selection according to an example of the invention. In this figure, whilst a large proportion of the circuit is largely the same as described previously in relation to FIG. 2, there is now included at least one on-die buffer, which may either be a (re-)assigned portion 215 of an already existing shared on-die data cache, such as Level 2 or level 3 cache 113, or it may comprise a newly included dedicated on-die buffer 215'. FIG. 10 shows several ways to interconnect the different portions of the overall adaptive compression and memory storage selection apparatus, firstly, predominantly using the already existing internal SoC shared data bus 112, or secondly, using dedicated data lines, such as dedicated GPU data line 129. Some implementations may use a mix of the shared bus 112, and dedicated communication links (not shown). The apparatus according to examples of the invention may also include a compression unit 720, decompression unit 750, control unit 760 and the various routing means, such as multiplexers 710,730, 740. In the example shown in FIG. 10, these may be formed as a combined compression/decompression/control unit 220, operatively coupled to the on-die display buffer 215/215' through the shared internal bus 112, and to the external memory through DMA unit 134. This figure also shows the case of a partially integrated network adapter, operatively coupled to an external physical layer (PHY) unit 136. This might the case, for example, when the network is a wireless network and the SoC includes the baseband portion of the wireless standard(s) in use, but the physical layer portion of the relevant wireless standard(s) is provided by an external unit. This might be an arrangement used in, for example, a tablet or smartphone.

Figure 11:
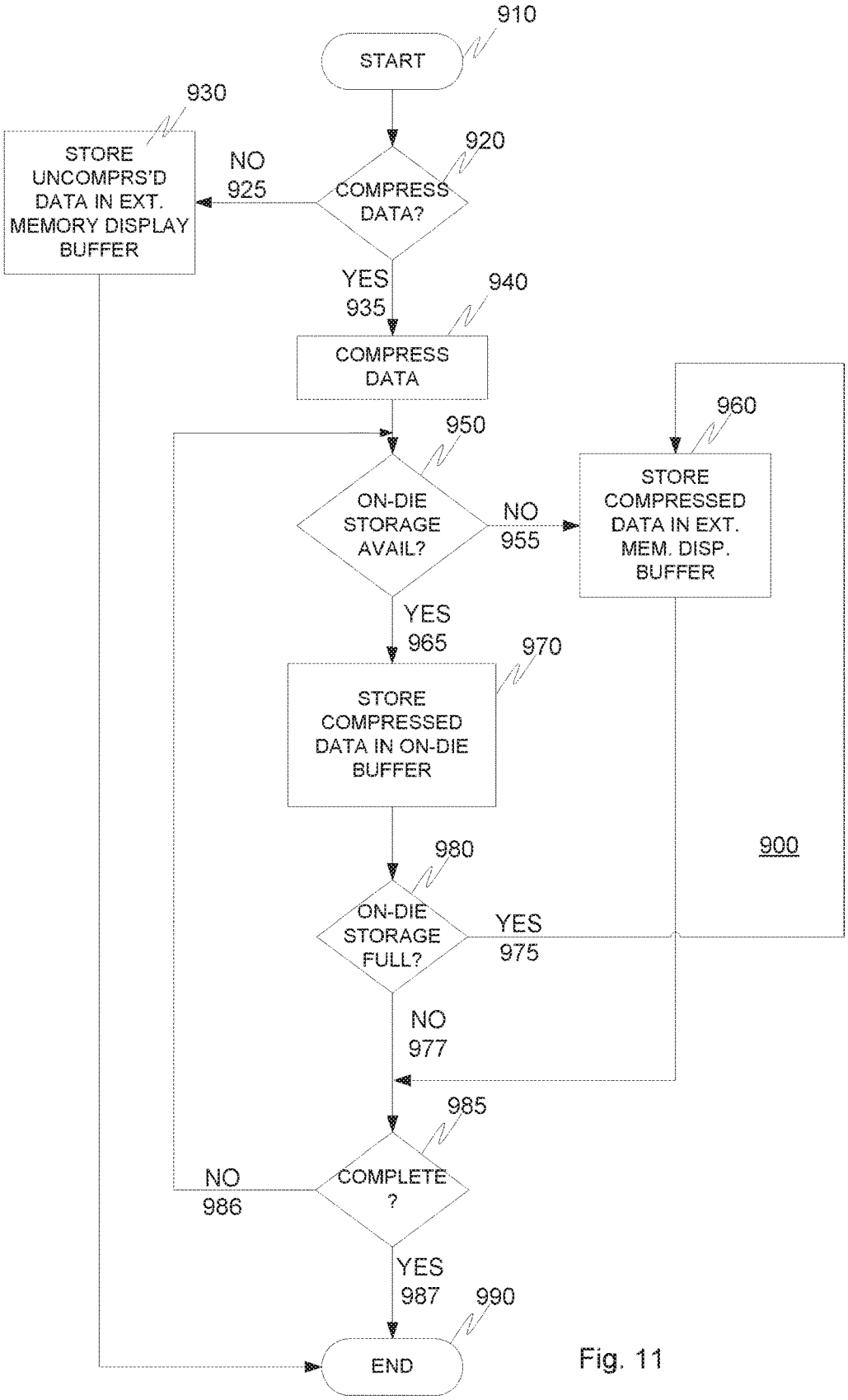
FIG. 11 shows an example flow diagram of a method of compression and external/on-die memory selection according to an example embodiment of the invention.

FIG. 11 shows an example flow diagram 900 of a compression portion of the method of compression/decompression of graphics overlay data and external/on-die display buffer selection according to an example embodiment of the invention.

The method starts 910 and then determines whether to compress the graphics data 920. If not (a No decision 925), for example because the computing system considers (on the basis of an assessment of provided parameters) it is not worthwhile to compress the graphics overlay data (or portion thereof) given the current situation, as it is likely to change in a short time frame, and hence the compression overhead is not worthwhile to absorb, then the method proceeds to store the uncompressed graphics data 930 (or portion thereof) in the external memory 170 based display buffer 175, in the usual way. However, if the determination to compress the data is positive (a Yes decision 935), because it is worthwhile to compress (i.e. the compression/decompression overheads are less than leaving the data uncompressed throughout), then the method proceeds to compress the graphics data in a suitable manner 940. After compression, the method may optionally determine whether there is any on-die storage, i.e. an on-die graphic display buffer 610, present in the computing system (or alternatively, determine if the on-die buffer is actually available for use, for example—the on-die display buffer may be present, but otherwise already full of data that may still be used, and hence is not operatively available). If there is a negative determination—No 955—(i.e. no on-die display buffer present, or it is already full/in use) then the method may proceed to store the compressed graphics data in the compressed portion 325 of the external memory based display buffer 175, as described in more detail above. If there is a positive determination—Yes 965—(i.e. the on-die buffer is present, not otherwise in use and hence available for use here), then the method may proceed to store the compressed graphics overlay data in the on-die buffer 970. The method may further comprise determining if the on-die buffer is full 980, after which if the determination is position (i.e. yes 975), the remainder of the compressed graphics overlay data may be re-routed and stored in the compressed portion 325 of the external memory display buffer 175, as described above. With a negative determination (i.e. the on-die buffer is not full), the method may check for having completed the compressed graphics storage at step 985. The completion may be inherent, and hence not specifically assessed in some implementations. If not complete, the method may return to the step of determining if there is (now) on-die storage available 950 described above. This might allow the further compressed graphics overlay data to start to be stored in the on-die display buffer 610, after it has started to become available. Once all graphics data that can be compressed has been compressed, the method ends 990. FIG. 11 is only an exemplary method, and the exact steps may be re-ordered dependent on the specific implementation in use.

A specific example of the power savings that may be derived by implementing the invention is now provided. In this example, the display buffer 175 is implemented within external DDR-RAM memory comprising 16 bit 533 MHz DDR3 memory modules. Their power consumption is ~430 mW per module, for a 2 GB/s data rate, and the energy usage is proportional to the data rate used. Four of such memory modules are usually used with an example (SoC) application processor. In this use case, the typical graphic buffer traffic is ~500 MB/s, which means the graphic buffer portion of the external memory traffic results in ~110 mW power consumption. If the compression ratio for the compression technique used for the graphic buffer is approx. 5:1 (i.e. 5× compression) and typical video/browsing applications in this use case are assessed to allow approx. 90% of frames to use compressed graphics from a compressed graphics buffer (i.e. only approx. 10% of the graphics data should remain uncompressed, given example usage stats for the use-case), then the estimated power saving, assuming there is no on-die compressed graphics buffer (i.e. there is only a DDR located compressed buffer 325), is approx. 80 mW. With the use of an additional suitably sized on-die graphics buffer, then the power savings can be much greater, since for up to 90% of the time, the external memory used for graphics overlay data may be in a lower (or even off) power state.

Examples portions of the invention may be implemented as a computer program for a computing system, for example multimedia computing system, or processor therein, said computer program for running on the multimedia computer system, at least including executable code portions for creating digital logic that is arranged to perform the steps of any method according to embodiments the invention when run on a programmable apparatus, such as a computer data storage system, disk or other non-transitory and tangible computer readable medium.

A computer program may be formed of a list of executable instructions such as a particular application program and/or an operating system. The computer program may for example include one or more of: a subroutine, a function, a procedure, an object method, an object implementation, an executable application, an applet, a servlet, a source code, an object code, a shared library/dynamic load library and/or other sequence of instructions designed for execution on a suitable computer system, such as an Integrated Circuit design system.

The computer program may be stored in a non-transitory and tangible fashion, for example, internally on a computer readable storage medium or (after being) transmitted to the computer system via a computer readable transmission medium. All or some of the computer program may be provided on computer readable media permanently, removably or remotely coupled to a programmable apparatus, such as an information processing system. The computer readable media may include, for example and without limitation, any one or more of the following: magnetic storage media including disk and tape storage media; optical storage media such as compact disk media (e.g., CD-ROM, CD-R, Blueray, etc.) digital video disk storage media (DVD, DVD-R, DVD-RW, etc) or high density optical media (e.g. Blueray, etc); non-volatile memory storage media including semiconductor-based memory units such as FLASH memory, EEPROM, EPROM, ROM; ferromagnetic digital memories; MRAM; volatile storage media including registers, buffers or caches, main memory, RAM, DRAM, DDR RAM etc.; and data transmission media including computer networks, point-to-point telecommunication equipment, and carrier wave transmission media, and the like. Embodiments of the invention are not limited to the form of computer readable media used.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

In the foregoing specification, the invention has been described with reference to graphics overlay data examples of embodiments of the invention. It will, however, be evident that various modifications and changes may be made therein without departing from the broader scope of the invention as set forth in the appended claims. For example, the method may equally be used to compress data that is not used as much as some other data.

The terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, a plurality of connections may be used, or replaced with a single connection that transfers multiple signals serially or in a time multiplexed manner. Likewise, single connections carrying multiple signals may be separated out into various different connections carrying subsets of these signals. Therefore, many options exist for transferring signals.

Each signal described herein may be designed as positive or negative logic. In the case of a negative logic signal, the signal is active low where the logically true state corresponds to a logic level zero. In the case of a positive logic signal, the signal is active high where the logically true state corresponds to a logic level one. Note that any of the signals described herein can be designed as either negative or positive logic signals. Therefore, in alternate embodiments, those signals described as positive logic signals may be implemented as negative logic signals, and those signals described as negative logic signals may be implemented as positive logic signals.

Furthermore, the terms "assert" or "set" and "negate" (or "deassert" or "clear") are used herein when referring to the rendering of a signal, status bit, or similar apparatus into its logically true or logically false state, respectively. If the logically true state is a logic level one, the logically false state is a logic level zero. And if the logically true state is a logic level zero, the logically false state is a logic level one.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, tablets, notepads, personal digital assistants, electronic games, automotive and other embedded systems, smart phones/cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

Unless otherwise stated as incompatible, or the physics or otherwise of the embodiments prevent such a combination, the features of the following claims may be integrated together in any suitable and beneficial arrangement. This is to say that the combination of features is not limited by the specific form of claims below, particularly the form of the dependent claims, as such a selection may be driven by claim rules in respective jurisdictions rather than actual intended physical limitation(s) on claim combinations. For example, reference to another claim in a dependent claim does not mean only combination with that claim is envisaged. Instead, a number of claims referencing the same base claim may be combined together.

The invention claimed is:

1. A System on Chip (SoC) integrated circuit multimedia computing apparatus for processing and displaying video data with graphic overlay data, said multimedia computing apparatus comprising:

a main processor, a CPU and a GPU, the main processor comprising a graphics frame buffer, an overlay circuit, a compression circuit and a control circuit:

the graphics frame buffer to store the graphic overlay data of a plurality of pixels to be displayed;

the overlay circuit to combine the video data with the graphic overlay data to produce a display data;

the compression circuit to compress the graphic overlay data prior to storage of said compressed graphic overlay data;

the control circuit including a first terminal coupled to a terminal of the compression circuit, the control circuit to determine when to compress the graphic overlay data dependent upon a refresh parameter of the graphic overlay data, wherein the graphic overlay data is compressed only while the graphic overlay data is stable, and wherein the graphic overlay data comprises shared data received from the main processor, the CPU and the GPU;

a shared on-die compressed display buffer arranged to store at least a first portion of the compressed graphic overlay data from the compression circuit; and an external shared memory including a shared compressed display buffer to store a second portion of the compressed graphic overlay data when the shared on-die compressed display buffer is full, wherein a portion of the external shared memory not used to store the second portion of the compressed graphic overlay data is powered down.

2. The multimedia computing apparatus of claim 1, further comprising a decompression circuit including a terminal coupled to a second terminal of the control circuit, the decompression circuit to decompress the graphic overlay data from the display buffer prior to supply of the graphic overlay data to the overlay circuit.

3. The multimedia computing apparatus of claim 1, wherein the shared on-die compressed display buffer is a dedicated on-die display buffer, or a dedicated portion of a shared cache on the SoC.

4. The multimedia computing apparatus of claim 1, further comprising at least one direct memory access (DMA) circuit arranged to load uncompressed graphic overlay data from an uncompressed display buffer in the external shared memory prior to the uncompressed graphic overlay data being combined as the graphic overlay data with the video data.

5. The multimedia computing apparatus of claim 1, wherein the external memory is dual data rate (DDR) memory.

6. The multimedia computing apparatus of claim 1, wherein the refresh parameter of the graphic overlay data is dependent upon system or user interaction timing with the graphic data.

7. The multimedia computing apparatus of claim 6, wherein user interaction timing is dependent on a length of time since a last user interaction with the multimedia computing apparatus.

8. The multimedia computing apparatus of claim 1, wherein the graphic overlay data is rendered from information with a low rate of change over time.

9. A method of adaptively compressing graphic overlay data in a System on Chip (SoC) integrated circuit multimedia computing system, said multimedia computing system comprising a main processor, a CPU and a GPU, the method comprising:

storing graphic overlay data of a plurality of pixels to be displayed;

dynamically controlling compression of the graphic overlay data in a display buffer dependent upon a refresh parameter of the graphic overlay data, wherein the graphic overlay data is compressed only while the graphic overlay data is stable, and wherein the graphic overlay data comprises shared data received from the main processor, the CPU and the GPU;

storing compressed graphic overlay data in a shared on-die compressed display buffer located within the same semiconductor die as a compression circuit;

storing a portion of the compressed graphic overlay data in a shared compressed display buffer of an external shared memory when the shared on-die compressed display buffer is full;

powering down a portion of the external shared memory not used to store the portion of the compressed graphic overlay data; and combining, via an overlay circuit, video data with the graphic overlay data to produce a display data.

10. The method of claim 9, further comprising decompressing the compressed graphic overlay data from the shared display buffer prior to supply of the graphic overlay data to the overlay circuit.

11. The method of claim 9, further comprising loading uncompressed graphic overlay data from an uncompressed graphic display buffer located in external shared memory prior to the uncompressed graphic overlay data being combined as the graphic overlay data with the video data.

12. The method of claim 9, wherein the refresh parameter of the graphic overlay data is dependent upon user interaction timing with the graphic data, or on a length of time since a last user interaction with the multimedia computing system.

13. A System on Chip (SoC) integrated circuit computing apparatus comprising:

a main processor, a CPU and a GPU, the main processor comprising a graphics frame buffer to store graphic overlay data of a plurality of pixels to be displayed;

an overlay circuit to combine video data with the graphic overlay data to produce a display data;

a compression circuit including a terminal to receive an enable signal, the compression circuit to dynamically control compression of the graphic overlay data in a display buffer dependent upon a refresh parameter of the graphic overlay data and based on the enable signal, wherein the graphic overlay data is compressed only while the graphic overlay data is stable and wherein the graphic overlay data comprises shared data received from the main processor, the CPU and the GPU;

a shared on-die compressed display buffer arranged to store at least a first portion of the compressed graphic overlay data from the compression circuit; and an external shared memory including a shared compressed display buffer to store a second portion of the compressed graphic overlay data when the shared on-die compressed display buffer is full, wherein a portion of the external shared memory not used to store the second portion of the compressed graphic overlay data is powered down.

14. The computing apparatus of claim 13, wherein the on-die compressed display buffer is a dedicated on-die display buffer, or a dedicated portion of a shared cache on the SoC.

15. The computing apparatus of claim 13, further comprising at least one direct memory access DMA circuit arranged to load uncompressed graphic overlay data from an uncompressed display buffer in external shared memory prior to the uncompressed graphic overlay data being combined as the graphic overlay data with the video data.

16. The computing apparatus of claim 13, further comprising: a control circuit including a terminal coupled to a terminal of the compression circuit, the control circuit to determine when to store the graphic overlay data in an on-die display buffer or an off-die display buffer based on the refresh parameter of the graphic overlay data.

* * * * *